US006918194B2

(12) United States Patent
Freese et al.

(10) Patent No.: US 6,918,194 B2
(45) Date of Patent: Jul. 19, 2005

(54) HEATING CONFIGURATION FOR A DRIER

(75) Inventors: Heinz Werner Freese, Apeldoorn (NL); Thomas Nawrot, Berlin (DE); Günter Steffens, Seeburg (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 4 days.

(21) Appl. No.: 10/893,661

(22) Filed: Jul. 16, 2004

(65) Prior Publication Data

US 2005/0050766 A1 Mar. 10, 2005

(30) Foreign Application Priority Data

Jul. 16, 2003 (DE) ..... 103 32 338

(51) Int. Cl.[7] ..... F26B 11/02

(52) U.S. Cl. ..... 34/604; 432/105; 431/351; 126/91 A

(58) Field of Search ..... 34/225, 235, 595, 34/596, 599, 602, 603, 60; 126/91 A; 431/351, 431/354; 432/105

(56) References Cited

U.S. PATENT DOCUMENTS

| | | | | |
|---|---|---|---|---|
| 1,311,235 A | | 7/1919 | Kemp et al. | |
| 2,486,315 A | * | 10/1949 | Morris | 432/46 |
| 4,526,535 A | * | 7/1985 | Wunderlich | 432/105 |
| 4,626,201 A | * | 12/1986 | Grantham | 432/105 |
| 5,538,340 A | * | 7/1996 | Brashears | 366/25 |
| 5,819,437 A | * | 10/1998 | Briggs | 34/604 |
| 6,116,195 A | * | 9/2000 | Valcic et al. | 122/19.1 |

* cited by examiner

*Primary Examiner*—Stephen Gravini
(74) *Attorney, Agent, or Firm*—John T. Winburn; Russell W. Warnock; Craig J. Loest

(57) ABSTRACT

A heating configuration for a drier, particularly for a laundry drier, has a burner with a burner head, a first heating channel with an inlet opening and an outlet opening, and a second heating channel with an inlet opening and an outlet opening. The cross-sectional area of the second heating channel is greater than the cross-sectional area of the first heating channel. The burner head projects into the inlet opening of the first heating channel and the outlet opening of the first heating channel projects into the inlet opening of the second heating channel. The first heating channel is disposed in the lower section of the second heating channel so that a uniform temperature distribution is achieved in the second heating channel.

12 Claims, 2 Drawing Sheets

HEATING CONFIGURATION FOR A DRIER

BACKGROUND OF THE INVENTION

Field of the Invention

The present invention relates to a heating configuration for a drier, particularly a laundry drier.

U.S. Pat. No. 1,311,235 discloses a gas burner with a burner head that projects into the inlet opening of a first heating channel. The annular opening between the inlet opening of the first heating channel and the burner serves as an air entry. The end side of the first heating channel projects by its outlet opening into the inlet side of a second heating channel which has a greater diameter than the first heating channel. The annular area between the first heating channel and the second heating channel serves as a further air entry opening.

That prior art configuration of the burner, the first heating channel, and the second heating channel is disadvantageous in that the temperature distribution is non-uniform within the heating channels.

SUMMARY OF THE INVENTION

It is accordingly an object of the invention to provide a heater configuration for a drier which overcomes the above-mentioned disadvantages of the heretofore-known devices and methods of this general type and which provides for a temperature distribution in the heating channel that is as uniform as possible so that a more reliable operation of the heating configuration is ensured and an improved temperature regulation is possible.

With the foregoing and other objects in view there is provided, in accordance with the invention, a heating configuration, comprising:

a burner with a burner head;

a first heating channel having an inlet portion formed with an inlet opening and an outlet portion formed with an outlet opening;

a second heating channel having an inlet portion formed with an inlet opening and an outlet portion formed with an outlet opening;

the second heating channel having a cross-sectional area greater than a cross-sectional area of the first heating channel;

the outlet portion of the first heating channel projecting into the inlet portion of the second heating channel; and the first heating channel being disposed in a lower portion of the second heating channel.

In other words, the heating configuration for a drier, particularly laundry drier, has a gas burner with a burner head, a first heating channel with an inlet opening and an outlet opening and a second heating channel with an inlet opening and an outlet opening and a cross-sectional area which is greater than the cross-sectional area of the first heating channel, wherein the burner head projects into the inlet opening of the first channel and the outlet opening of the first heating channel projects into the inlet opening of the second heating channel. In that the first heating channel is arranged in the lower section of the second heating channel or the first heating channel is arranged at the second heating channel to be eccentrically offset downwardly, the air entry opening for supplementary air between the first heating channel and the second heating channel is formed principally at the upper side of the second heating channel. Due to this measure it is possible for the hot gases, which issue from the first heating channel and which due to heat lift preferentially flow upwardly in the upper region of the second heating channel, to better mix with supplementary air so that the effect of improved intermixing and more uniform temperature distribution is reinforced by introduction of the first heating channel into the lower section of the second heating channel. By virtue of the uniform temperature distribution in this heating channel arrangement a more precise detection of the temperature of the gases disposed in the heating channel arrangement is possible so that a more precise temperature regulation is possible.

In accordance with an advantageous embodiment the front lower section of the first heating channel is connected with the rear lower section of the second heating channel by fastening elements.

In accordance with a further advantageous embodiment of the invention, the heating configuration has a guide device in the upper section of the first heating channel adjacent to the outlet opening thereof, whereby the hot gases which flow from the burner head in direction towards the outlet opening of the second heating channel are deflected downwardly. It is thereby possible to guide the hot air or hot gases, which flow out of the first heating channel and which due to air lift have a tendency to flow upwardly, into the middle section of the second heating channel so that overheating of the upper section of the second heating channel is avoided. Through provision of the guide device it is therefore possible to achieve a more uniform temperature distribution over the cross-sectional area. Moreover, supplementary air, which due to the provision of the guide device in the upper section of the first heating channel is better mixed with the hot gases flowing out of the first heating channel, enters into the second heating channel between the outlet opening of the first heating channel and the inlet opening of the second heating channel. Due to the better mixing of the supplementary air and the hot gases flowing out of the first heating channel and thus a more uniform temperature distribution over the cross-section of the second heating channel, hot zones within the second heating channel are avoided, which ensures a more reliable operation of the heating configuration.

In accordance with an additional feature of the invention, the guide device is constructed as an inclined wall which extends at a downward slope in flow direction from a middle upper section of the first heating channel to the outlet opening of the first heating channel. Flame which issues from the burner and has already mixed with a first supplementary air which has entered between the burner and the inlet opening of the first heating channel is thereby conducted downwardly in the outlet region of the first heating channel. This is advantageous, since the flame issuing from the burner head flows upwardly due to heat lift and is conducted downwardly at the end of the first heating channel by the guide device.

In accordance with a particularly advantageous embodiment of the invention, the inclined wall is integrated in the end section of the first heating channel. This is particularly advantageous when the heating channel is made of a metal plate so that for formation of the guide device it is merely necessary to downwardly indent the upper end section adjacent to the outlet opening of the first heating channel by means of a stamping device. A particularly simple and advantageous construction of the guide device is thereby guaranteed. Moreover, through construction of the guide device in that manner the inlet opening for supplementary air between the first heating channel and the second heating channel is enlarged in the region of the guide device so that supplementary air can flow in more easily and thus in greater quantity in this region so that the upper side of the second heating channel is supplied with more supplementary air, whereby overheating of the upper side of the second heating channel is counteracted.

In accordance with a further feature of the invention, the burner is arranged in the lower section of the first heating channel. The hot flame which issues from the burner head and which equally has a tendency to flow upwardly due to heat lift, is thereby better retained in the middle section of the first heating channel upstream of the burner head and better mixed with the supplementary air entering between the burner and the inlet opening of the first heating channel. A more uniform distribution is thereby already achieved in the first heating channel.

In accordance with again a further feature of the invention, there is disposed at the outlet opening of the second heating channel a deflection channel by which the hot gases are deflected upwardly. This deflection channel preferably has an inclined plane which extends obliquely upwardly from the lower middle section of the deflection channel in flow direction. By virtue of this inclined plane a form of baffle plate is made available, at which the hot gases or the hot air is or are not only deflected upwardly, but also mixed more uniformly over the cross-section.

Overall, formation of so-called hot 'temperature strands' and hot regions as well as flow stratification in the heating channel configuration are avoided by the above-described heating configuration.

In accordance with a concomitant feature of the invention, an air conveying device is provided downstream of the outlet opening of the second heating channel in order to manage conveying of the air from the burner in direction towards the deflection channel.

Other features which are considered as characteristic for the invention are set forth in the appended claims.

Although the invention is illustrated and described herein as embodied in a heating configuration for a drier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
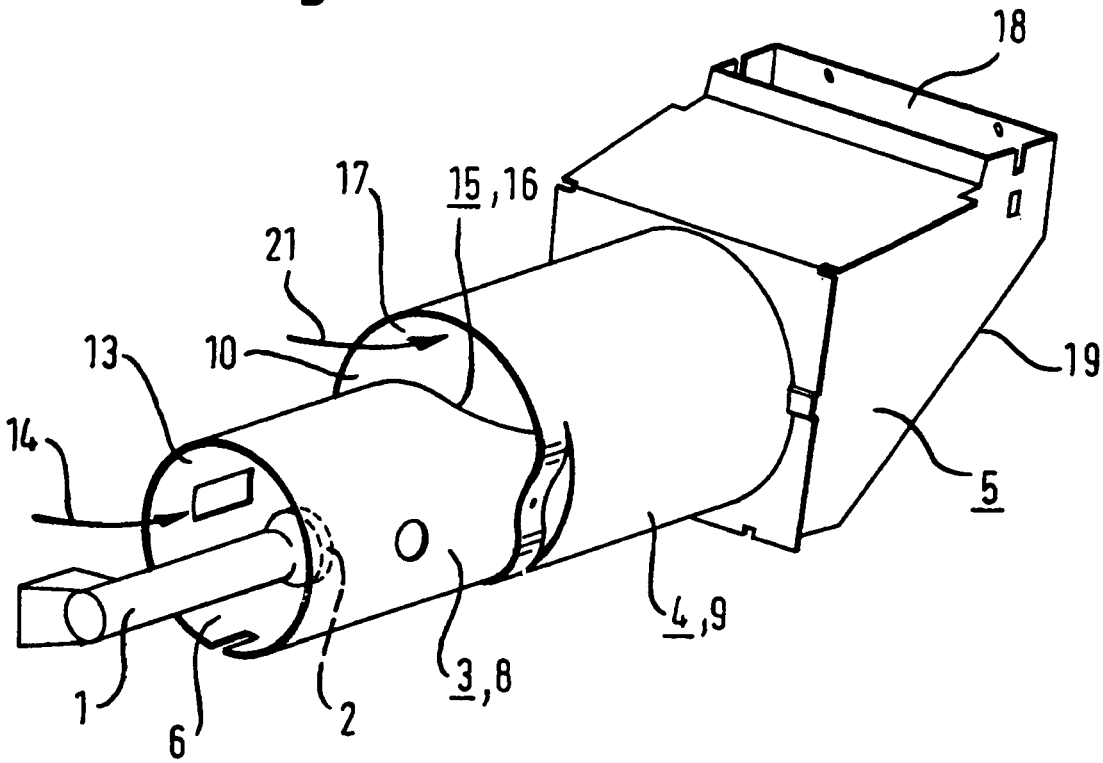
FIG. 1 is a perspective view of the heating configuration for a drier according to the invention.
Figure 4:
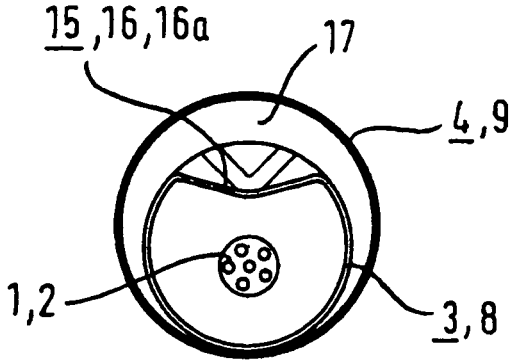
FIG. 4 is a side view of a section taken along the line IV—IV shown in FIG. 2.
Figure 2:
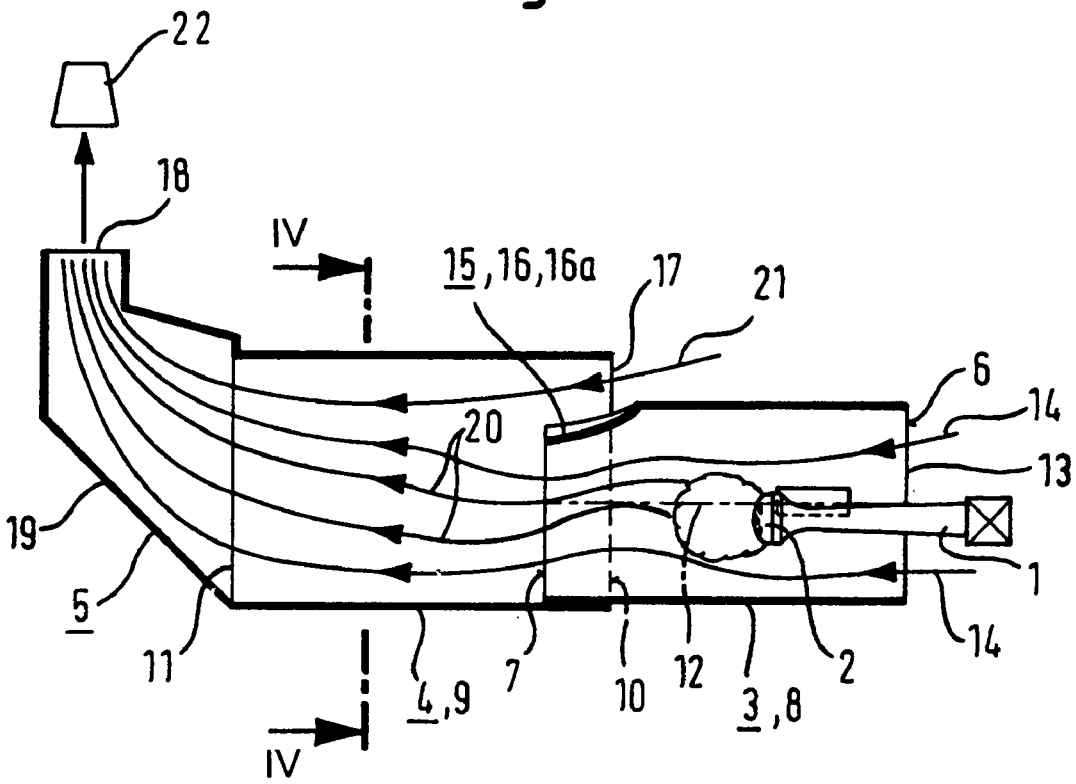
FIG. 2 is a side view of the heating configuration for a drier according to FIG. 1.
Figure 3:
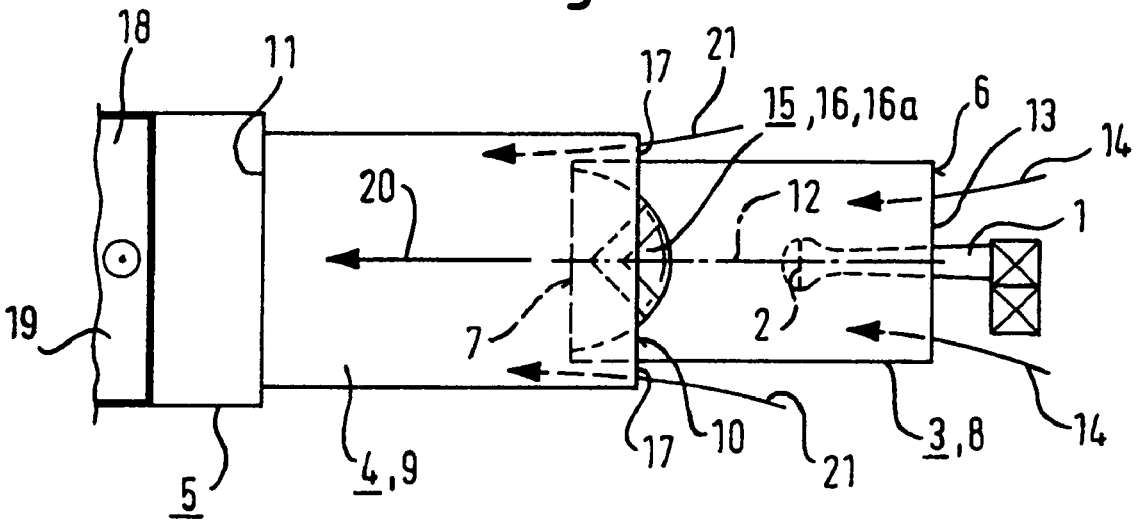
FIG. 3 is a plan view of the heating configuration for a drier according to FIG. 1.

Referring now to the figures of the drawing in detail and first, particularly, to FIGS. 1 and 4 thereof, there is shown a heating configuration with a burner 1 having a burner head 2, a first heating channel 3, a second heating channel 4, and a deflection channel 5. The first heating channel 3 is a circular cylindrical or an oval pipe section which is made of sheet metal and which is formed with an inlet opening 6 and an outlet opening 7. The second heating channel 4 is a cylindrical pipe section 9 made of sheet metal and formed with an inlet opening 10 and an outlet opening 11. The first heating channel 3 has a smaller diameter than the second heating channel 4. The first heating channel 3 projects by the outlet opening 7 thereof with an overlap into the inlet opening 10 of the second heating channel and the first heating channel 3 is disposed at the underside of the second heating channel 4 and connected therewith. The burner 1 projects by the burner head 2 thereof into the inlet opening 6 of the first heating channel 3 in such a way that the burner head is disposed in the lower section, i.e., below a centerline 12 of the first heating channel 3.

An approximately annular first air entry opening 13, by way of which a first supplementary air 14 can enter the first heating channel 3, is formed between the burner 1 and the inlet opening 6 of the first heating channel. Arranged adjacent to the outlet opening 7 of the first heating channel 3 and at the upper end section of the first heating channel 3 is a guide device 15 which forces the hot gases or hot air, which flow or flows over the first heating channel 3, downwardly in the region of the outlet opening 7 of the first heating channel 3 so that the hot air enters the lower section of the second heating channel 4. The guide device 15 is formed integrally at the cylindrical pipe section 8 of the first heating channel in that the upper end section of the cylindrical pipe section 18 is deformed in the shape of a slightly concave indentation 16 by means of a stamping process or bending process. The indentation in that case comprises an inclined wall 16*a* which extends at a downward inclination in flow direction 20 from a middle upper section of the first heating channel 3 to the outlet opening 7 of the first heating channel 3.

A second, crescent-shaped air entry 17, which is formed with a further enlargement in the region of the indentation 16, is formed between the outlet opening 7 of the first heating channel 3 and the inlet opening 10 of the second heating channel 4 (FIG. 4).

The deflection channel 5, which has initially a substantially square cross-section and which is increasingly rectangular up to its upwardly directed outlet opening 18, is hermetically connected with the outlet opening 11 of the second heating channel 4. The deflection channel 5 has an inclined plane 19 which extends obliquely upwardly from the lower middle section of the deflection channel 5 in flow direction 20. Arranged downstream of the outlet opening 18, i.e., on the outflow side of the deflection channel 5 is an air conveying device 22 which conveys air through the heating configuration in flow direction 20.

Due to the fact that the burner head is disposed in the lower section of the first heating channel 3 and due to the fact that a guide device 15 in the form of the depression 16 is provided at the upper end section adjacent to the outlet opening 7 of the first heating channel 3 and due to the fact that the first heating channel is arranged eccentrically in the lower section of the second heating channel 4, the flame or the hot air or hot gases which mixes or mix therewith and which always has or have the tendency to migrate upwardly due to thermal lift and thus excessively heat the upper sections of the first and second heating channel, is or are forced downwardly in each section of the heating configuration or kept in a middle section of the first heating channel 3 or the second heating channel 4. The entire heating configuration particularly of the first heating channel 3 and the second heating channel 4 is preferably arranged horizontally.

However, it is also possible to arrange the heating configuration to be swung upwardly at a preferred angle between 0° and 45° together with the deflection channel 5, whereby the illustrated advantageous manner of effect is still given.

Due to the afore-described heating configuration an improved thorough mixing of the gases is achieved, which has the consequence of a more uniform temperature distribution over the flow cross-section. With a more uniform temperature distribution, there is also possible a more precise detection of the temperature of the gases flowing in the heating configuration so that a more exact setting or regulation of the temperature of the gases is possible.

The first supplementary air 14 is fed behind the burner by way of the first air entry opening 13. A second supplementary air 21 is fed into the heating configuration by way of the second air entry opening 17. This feed of first supplementary air 14 and second supplementary air 21 has the advantage that in the region of the burner only a part of the air quantity required for drying has to flow through the first heating channel 3, so that the burner readily ignites and has a good flame formation. Lifting-off of the flame of the burner is thereby prevented and thereby also combustion noise is avoided. In addition, the CO emission and the emission of unburnt fuel due to the lesser cooling are thereby avoided.

The burner burns with a relatively short and voluminous flame in the first heating channel 3, whereby a good intermixing of the hot exhaust gases with the cold, first supplementary air 14 is managed.

This application claims the priority, under 35 U.S.C. § 119, of German patent application No. 103 32 338.4, filed Jul. 16, 2003; the entire disclosure of the prior application is herewith incorporated by reference.

We claim:

1. A heating configuration, comprising:

a burner with a burner head;

a first heating channel having an inlet portion formed with an inlet opening and an outlet portion formed with an outlet opening;

a second heating channel having an inlet portion formed with an inlet opening and an outlet portion formed with an outlet opening;

said second heating channel having a cross-sectional area greater than a cross-sectional area of said first heating channel;

said outlet portion of said first heating channel projecting into said inlet portion of said second heating channel; and said first heating channel being disposed in a lower portion of said second heating channel.

2. The heating configuration according to claim 1, which comprises a guide device in an upper section of said first heating channel adjacent said outlet opening thereof, for downwardly deflecting hot gases flowing from said burner head in a direction towards said outlet opening of said second heating channel.

3. The heating configuration according to claim 1, wherein said guide device comprises an inclined wall extending at a downward slope in flow direction from a middle upper portion of said first heating channel to said outlet opening of said first heating channel.

4. The heating configuration according to claim 3, wherein said inclined wall is an indentation formed in a wall end portion of said first heating channel.

5. The heating configuration according to claim 1, wherein a part of said burner projecting into said first heating channel is disposed substantially in a lower part of said first heating channel.

6. The heating configuration according to claim 1, wherein a first air entry opening is formed between a perimeter of said inlet opening of said first heating channel and said burner, and a second air entry is formed between a perimeter of said inlet opening of said second heating channel and a perimeter of an outlet portion of said first heating channel.

7. The heating configuration according to claim 1, which further comprises a deflection channel connected to said outlet opening of said second heating channel and disposed to upwardly deflect gases flowing from said second heating channel.

8. The heating configuration according to claim 7, wherein said deflection channel has an inclined surface extending obliquely upwardly from a lower middle section of said deflection channel.

9. The heating configuration according to claim 1, which comprises an air conveying device disposed downstream of said outlet opening of said second heating channel with respect to a direction of a flow of gases out of said second heating channel.

10. The heating configuration according to claim 1, wherein said outlet portion of said first heating channel has a base portion connected to a base portion of said inlet portion of said second heating channel.

11. The heating configuration according to claim 1, wherein said burner and said heating channels are configured for assembly in a drier apparatus.

12. In combination with a laundry drier, the heating configuration according to claim 1.

* * * * *